US010703105B2

(12) United States Patent
Nakagawa et al.

(10) Patent No.: US 10,703,105 B2
(45) Date of Patent: Jul. 7, 2020

(54) LIQUID EJECTION HEAD AND METHOD FOR CIRCULATING LIQUID

(71) Applicant: CANON KABUSHIKI KAISHA, Tokyo (JP)

(72) Inventors: Yoshiyuki Nakagawa, Kawasaki (JP); Kazuhiro Yamada, Yokohama (JP); Noriyasu Nagai, Tokyo (JP); Takuro Yamazaki, Inagi (JP); Toru Nakakubo, Kawasaki (JP); Akira Yamamoto, Yokohama (JP); Masafumi Morisue, Tokyo (JP); Ryo Kasai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/140,896

(22) Filed: Sep. 25, 2018

(65) Prior Publication Data

US 2019/0023018 A1 Jan. 24, 2019

Related U.S. Application Data

(63) Continuation of application No. PCT/JP2017/012113, filed on Mar. 24, 2017.

(30) Foreign Application Priority Data

Mar. 29, 2016 (JP) ..... 2016-065627

(51) Int. Cl.
*B41J 2/175* (2006.01)
*B41J 2/14* (2006.01)
*B41J 2/18* (2006.01)

(52) U.S. Cl.
CPC ..... *B41J 2/175* (2013.01); *B41J 2/1404* (2013.01); *B41J 2/18* (2013.01); *B41J 2202/12* (2013.01)

(58) Field of Classification Search
CPC ... B41J 2/175; B41J 2/1404; B41J 2/18; B41J 2202/12
See application file for complete search history.

(56) References Cited

U.S. PATENT DOCUMENTS 6,244,694 B1 6/2001 Weber et al.
6,834,940 B2 12/2004 Sugioka et al.
(Continued)

FOREIGN PATENT DOCUMENTS

CN 101670998 A 3/2010
CN 105383176 A 3/2016
(Continued)

OTHER PUBLICATIONS

International Search Report and Written Opinion dated May 23, 2017, in International Application No. PCT/JP2017/012113.
(Continued)

*Primary Examiner* — Yaovi M Ameh
(74) *Attorney, Agent, or Firm* — Venable LLP

(57) ABSTRACT

A liquid ejection head is provided with an ejection orifice array having multiple ejection orifices in order to eject a liquid; multiple energy-generating elements for generating energy in order to eject the liquid; a substrate provided with the energy-generating elements; a through-port array having multiple through-ports penetrating the substrate; multiple linear liquid flow paths positioned between the through-port array and the ejection orifice array and connected to respective ejection orifices of the ejection orifice array and respective through-ports of the through-port array; and first and second electrodes arranged in each of the multiple liquid flow paths for generating an electroosmotic flow in the liquid.

12 Claims, 10 Drawing Sheets

(56) References Cited

U.S. PATENT DOCUMENTS

| | | | | |
|---|---|---|---|---|
| 9,211,721 | B2 | 12/2015 | Govyadinov et al. | |
| 9,403,372 | B2 | 8/2016 | Taff et al. | |
| 9,457,584 | B2 | 10/2016 | Govyadinov et al. | |
| 9,539,810 | B2 | 1/2017 | Tamura et al. | |
| 9,623,659 | B2 | 4/2017 | Govyadinov et al. | |
| 9,731,504 | B2 | 8/2017 | Sekine et al. | |
| 9,969,177 | B2 | 5/2018 | Govyadinov et al. | |
| 10,040,290 | B2 | 8/2018 | Okushima et al. | |
| 2008/0000772 | A1* | 1/2008 | Bazant | G01N 27/26 204/450 |
| 2012/0056940 | A1* | 3/2012 | Sakurai | B41J 2/14145 347/54 |
| 2013/0146459 | A1* | 6/2013 | Bazant | B01F 13/0071 204/454 |
| 2015/0070446 | A1* | 3/2015 | Taff | B41J 2/17596 347/85 |
| 2017/0274647 | A1 | 9/2017 | Aoki et al. | |
| 2018/0201024 | A1 | 7/2018 | Govyadinov et al. | |
| 2019/0001698 | A1 | 1/2019 | Yamazaki et al. | |
| 2019/0001699 | A1 | 1/2019 | Nakakubo et al. | |

FOREIGN PATENT DOCUMENTS

| | | | |
|---|---|---|---|
| JP | 2014-531349 | A | 11/2014 |
| WO | 2013/048382 | A1 | 4/2013 |
| WO | 2013/130039 | A1 | 9/2013 |

OTHER PUBLICATIONS

International Preliminary Report on Patentability dated Oct. 11, 2018, in International Application No. PCT/JP2017/012113.

U.S. Appl. No. 16/134,211, Masafumi Morisue, Yoshiyuki Nakagawa, Kazuhiro Yamada, Takuro Yamazaki, Ryo Kasai, Tomoko Kudo, Takashi Sugawara, filed Sep. 18, 2018.

U.S. Appl. No. 16/141,055, Yoshiyuki Nakagawa, Kazuhiro Yamada, Noriyasu Nagai, Takuro Yamazaki, Toru Nakakubo, Akira Yamamoto, Masafumi Morisue, Ryo Kasai, filed Sep. 25, 2018.

Office Action dated Dec. 13, 2019, in Chinese Patent Application No. 201780021459.1.

Office Action dated Feb. 4, 2020, in Japanese Patent Application No. 2016-065627.

* cited by examiner

LIQUID EJECTION HEAD AND METHOD FOR CIRCULATING LIQUID

CROSS-REFERENCE TO RELATED APPLICATIONS

This application is a Continuation of International Patent Application No. PCT/JP2017/012113, filed on Mar. 24, 2017, which claims the benefit of Japanese Patent Application No. 2016-065627, filed on Mar. 29, 2016, both of which are hereby incorporated by reference herein in their entirety.

BACKGROUND OF THE INVENTION

Field of the Invention

The present invention relates to a liquid ejection head and a method for circulating a liquid, and particularly relates to a configuration for causing a liquid to flow in the vicinity of an ejection orifice.

Description of the Related Art

In a liquid ejection head used in a liquid ejection apparatus which ejects a liquid such as an ink, volatile components in the liquid evaporate from an ejection orifice for ejecting the liquid, and the liquid in the vicinity of the ejection orifice thickens. As a result, the ejection speed of the droplets to be ejected may be changed or the landing accuracy may be adversely affected. In particular, in a case where the pause time after ejection is long, the increase in viscosity of the liquid becomes remarkable, solid components of the liquid adhere to the vicinity of an ejection orifice, and the fluid resistance of the liquid increases due to the solid components, which may result in ejection failure.

As one of the measures to prevent such a thickening phenomenon of the liquid, a method of flowing a fresh liquid into a pressure chamber is known. As a means for flowing a liquid, firstly, there is a system of circulating a liquid in a head by a differential pressure system. Secondly, there is a system of using a micro-pump of an alternating current electroosmotic flow (ACEOF) (International Publication No. WO 2013/130039).

In a case of the configuration in International Publication No. WO 2013/130039, it is possible to flow a fresh liquid into a pressure chamber. However, since a liquid flow path is separated from a common supply port and joins the common supply port again in the configuration, the direction of the liquid flow path is required to be changed on the way. For this reason, the liquid flow path becomes long, and a large arrangement space is required. Therefore, it is difficult to arrange the ejection orifices in a high dense state, and the size of a recording element tends to be large.

It is an object of the present invention to provide a liquid ejection head with which the thickening of a liquid due to the evaporation of the liquid from an ejection orifice can be reduced and in which ejection orifices can be arranged in a high dense state.

SUMMARY OF THE INVENTION

A liquid ejection head of the present invention includes: an ejection orifice array arraying a plurality of ejection orifices for ejecting a liquid; a plurality of energy-generating elements for generating energy in order to eject the liquid; a substrate provided with the plurality of energy-generating elements; a through port array arraying a plurality of through ports penetrating the substrate; a plurality of linear liquid flow paths positioned between the through port array and the ejection orifice array, and connected to respective ejection orifices of the ejection orifice array and respective through ports of the through port array; and electrodes arranged in each of the plurality of liquid flow paths, and for generating an electroosmotic flow in the liquid.

Further features of the present invention will become apparent from the following description of exemplary embodiments with reference to the attached drawings.

DESCRIPTION OF THE EMBODIMENTS

Hereinafter, the liquid ejection heads according to the embodiments of the present invention will be described while referring to drawings, respectively. The following respective embodiments are directed to an ink jet recording head and an ink jet recording apparatus, which eject ink, but the present invention is not limited thereto. The present invention can be applied to a printer, a copying machine, a facsimile machine having a communication system, a device such as a word processor having a printer unit, and further, an industrial recording device obtained by a complex combination of various kinds of processing units. The present invention can also be used for the application of, for example, preparing biochips, printing an electronic circuit, applying a resist to form a circuit pattern of a semiconductor wafer, and the like. The embodiments described below are preferred specific examples of the present invention, and various technically preferable limitations are given. However, the present invention is not limited to the embodiments described below as long as it is along the spirit of the present invention.

First Embodiment

Figure 1A:
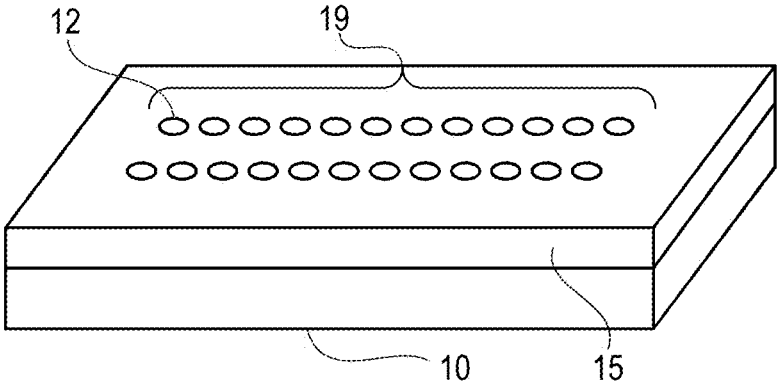
FIG. 1A is a schematic view of the liquid ejection head according to a first embodiment of the present invention.
Figure 1B:
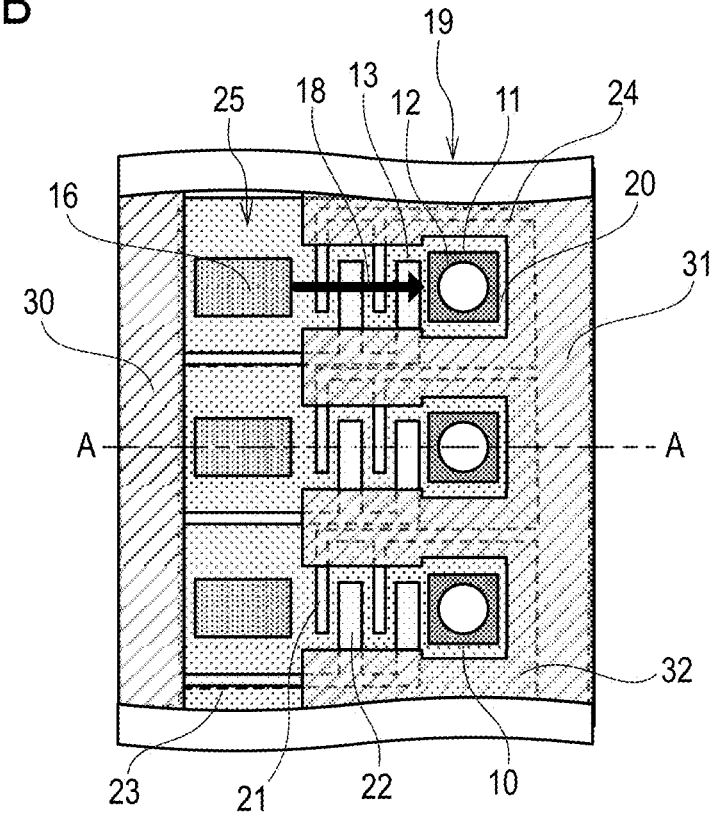
FIG. 1B is a schematic view of the liquid ejection head according to the first embodiment of the present invention.

FIG. 1A a perspective view of a recording element substrate of the liquid ejection head according to a first embodiment of the present invention. FIG. 1B is a sectional view of the recording element substrate shown in FIG. 1A, FIG. 1C is a sectional view taken along the line A-A in FIG. 1B, and FIG. 1D is a schematic view showing a flow velocity distribution in the same cross section as that in FIG. 1C.

The recording element substrate 1 has a substrate 10 and an ejection orifice forming member 15. The ejection orifice forming member 15 is bonded to the substrate 10. The substrate 10 is provided with an energy-generating element 11 for generating energy in order to eject an ink. Multiple ejection orifices 12 are arranged in the ejection orifice forming member 15, and the multiple ejection orifices 12 are arrayed in a row to form an ejection orifice array 19. The recording element substrate 1 of the present embodiment has two rows of the ejection orifice array 19, but the number of the ejection orifice arrays 19 is not limited thereto.

Figure 1C:
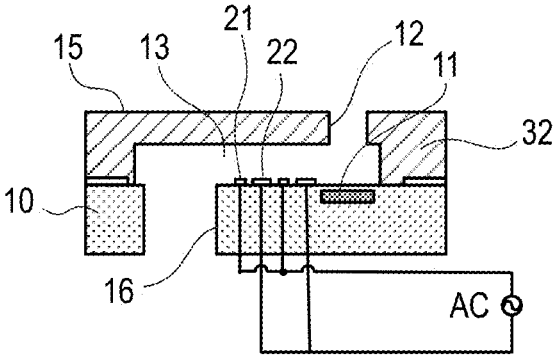
FIG. 1C is a schematic view of the liquid ejection head according to the first embodiment of the present invention.
Figure 1D:
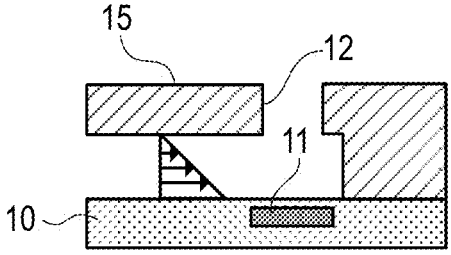
FIG. 1D is a schematic view showing a flow velocity distribution in the liquid ejection head according to the first embodiment of the present invention.

Referring to FIGS. 1B and 1C, in the substrate 10, multiple first through ports 16 penetrating the substrate 10 from the front surface to the back surface are formed. In the space between the ejection orifice forming member 15 and the substrate 10, multiple first liquid flow paths 13 through which the first through holes 16 and pressure chambers 20 communicate with each other and ink flows, are formed. The first liquid flow path 13 extends linearly. With respect to the ink flow, multiple pressure chambers 20 inside each of which an energy-generating element 11 is arranged, are formed on the downstream side of the first liquid flow paths 13, respectively between the ejection orifice forming member 15 and the substrate 10. In the present invention, the pressure chamber 20 is an area sandwiched between partition walls 32, and indicates an area where an energy-generating element 11 is arranged. In a broader sense, the area indicates an area where pressure acts when the energy-generating element 11 is driven. The ejection orifice 12 is opposite to the energy-generating element 11 in a direction perpendicular to the surface opposing to the ejection orifice forming member 15 of the substrate 10. The pressure chamber 20 and the first through port 16 are arranged for each of the corresponding liquid flow paths or each of the corresponding ejection orifices 12. Accordingly, the first through port 16, the first liquid flow path 13, and the pressure chamber 20 form an independent flow path for each of the ejection orifices 12. The multiple first through ports 16 form a first through port array 25. The first through port array 25 extends along the ejection orifice array 19.

The ink is supplied from the first through port 16 to the pressure chamber 20 through the first liquid flow path 13. The ink supplied to the pressure chamber 20 is heated with the energy-generating element 11, and is ejected from the ejection orifice 12 by the pressure of generated bubbles.

Two kinds of electrodes are arranged in the first liquid flow path 13. These electrodes are hereinafter referred to as a first electrode 21 and a second electrode 22. Both of the first electrode 21 and the second electrode 22 are arranged on the substrate 10. The first electrode 21 is connected to one end (+ terminal) of an alternating current power supply AC, and the second electrode 22 is connected to the other end (– terminal) of the alternating current power supply AC. The size of the first electrode 21 is smaller than that of the second electrode 22 in a direction of the ink flow, that is, a direction along the first liquid flow path 13. On the other hand, the size of the first electrode 21 and the size of the second electrode 22 are approximately the same as each other in a direction perpendicular to the direction of the ink flow. Therefore, the area of the first electrode 21 in contact with ink is smaller than that of the second electrode 22 in contact with ink.

Multiple first electrodes 21 and multiple second electrodes 22 are respectively arranged in the first liquid flow path 13, and are further alternately arranged. The first electrode 21 and second electrode 22 are arranged from the first through hole 16 toward the pressure chamber 20 in the order of a first electrode 21, a second electrode 22, a first electrode 21, a second electrode 22, . . . . . However, in the first liquid flow path 13 and in the second liquid flow path 14, at least one set of a first electrode 21 and a second electrode 22, which are adjacent to each other, may be arranged. Multiple first electrodes 21 are connected to a first common wiring 24, and multiple second electrodes 22 are connected to a second common wiring 23. The first wiring 24 and the second wiring 23 are arranged in a lower area (lower area of the partition wall 32) of the ejection orifice forming member 15. The first wiring 24 and the second wiring 23 are placed on the sides that are opposite to each other sandwiching the first liquid flow path 13 in between. Multiple first electrodes 21 and multiple second electrodes 22 extend in a comb shape in directions opposite to each other from the first wiring 24 and the second wiring 23, respectively. The second wiring 23 extends along the first liquid flow path 13, and further extends between the first through ports 16 that are adjacent to each other, and is connected to a first common wiring 30 at the end of the first through port 16 as viewed from the second electrode 22. The first wiring 24 extends along the first liquid flow path 13, and further extends between the energy-generating elements 11 that are adjacent to each other, and is connected to a second common wiring 31 at the end of the energy-generating element 11 as viewed from the first electrode 21. As a result, the first wiring 24 and the second wiring 23 are prevented from being complicated, and an increase in size of the element substrate 10 is suppressed.

When the first electrode 21 and the second electrode 22 are energized, an alternating current potential is applied to the first electrode 21 and the second electrode 22. As a result, as shown in FIG. 1D, in the liquid flow path, a flow velocity distribution in which the flow velocity is high on the front side of the substrate 10, and asymptotically approaches zero as approaching the ejection orifice forming member 15 is generated. The reason why this flow velocity distribution is generated will be described with reference to FIGS. 2A to 2D.

Figure 2A:
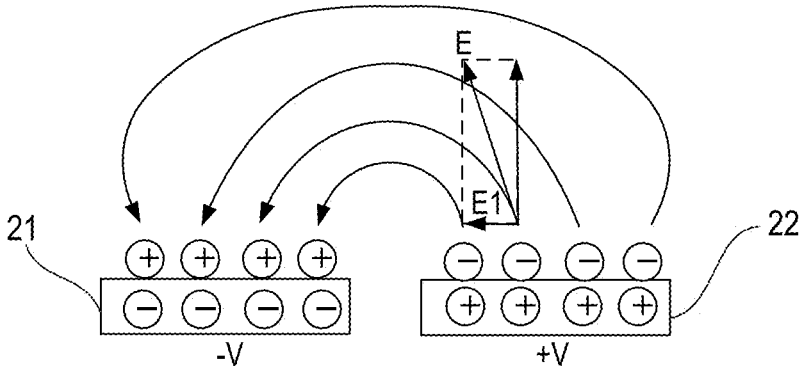
FIG. 2A is a schematic view for describing a mechanism of the generation of driving force by an electroosmotic flow.

An alternating current voltage is applied to a first electrode 21 and a second electrode, and herein, the timing at which the negative voltage (−V) is applied to the first electrode 21 and the positive voltage (+V) is applied to the second electrode is studied. It is assumed that the sizes of the first electrode 21 and the second electrode are the same as each other in FIG. 2A. As shown in FIG. 2A, an electric double layer is generated in the first electrode 21 and in the second electrode. That is, a negative voltage (−V) is applied to a first electrode 21, the ink in contact with the first electrode 21 is positively charged, and an electric double layer is formed. In a similar manner as in the above, a positive voltage (+V) is applied to a second electrode 22, the ink in contact with the electrode 22 is negatively charged, and an electric double layer is formed.

Figure 2B:
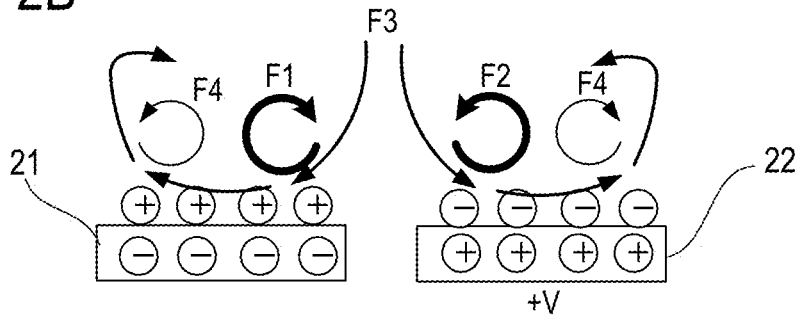
FIG. 2B is a schematic view for describing a mechanism of the generation of driving force by an electroosmotic flow.

A semicircular electric field E that is directed from the second electrode 22 to the first electrode 21 is formed in the ink. This electric field is symmetrical with respect to a line intermediate between the first electrode 21 and the second electrode 22. Electric field components E1 parallel to the surfaces of the first and second electrodes 21 and 22 are generated on the surfaces of the first and second electrodes 21 and 22, respectively. These electric field components E1 exert Coulomb force on the electric charge induced on the first and second electrodes 21 and 22, respectively. The electric field component E1 is directed to the left in the drawing at a position close to the gap between the electrodes. Since the positive charge receives a force in the same direction as that of the electric field, as shown in FIG. 2B, a rotating vortex F1 in which the ink in contact with the first electrode 21 flows to the left in the drawing is generated.

Since the negative charge receives a force in a direction opposite to the direction of the electric field, a rotating vortex F2 in which the ink in contact with the second electrode 22 flows to the right in the drawing is generated. Since the ink flows in a direction away from the gap between the electrodes, an ink flow F3 is generated in the gap between the electrodes so as to supply the ink. In addition, since the direction of the electric field is reversed at the end part away from the gap between electrodes of the electrodes, a rotating vortex F4 in which the ink flows toward the gap between the electrodes is generated. However, the Coulomb force received in the ink is small because the electric field is weak. As a result, a flow such as a stirring flow that flows from the gap between the electrodes toward the first and second electrodes 21 and 22 in a direction away from the gap between the electrodes on the first and second electrodes 21 and 22 is formed. These flows are bilaterally symmetrical to each other between the first electrode 21 and the second electrode 22.

Figure 2C:
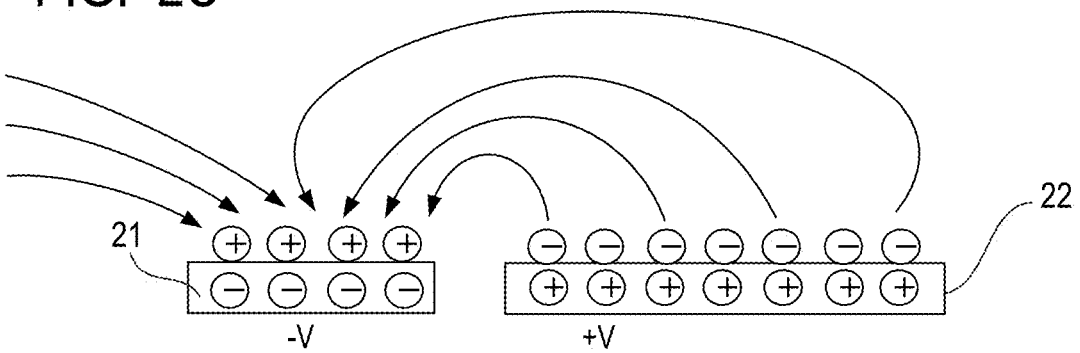
FIG. 2C is a schematic view for describing a mechanism of the generation of driving force by an electroosmotic flow.
Figure 2D:
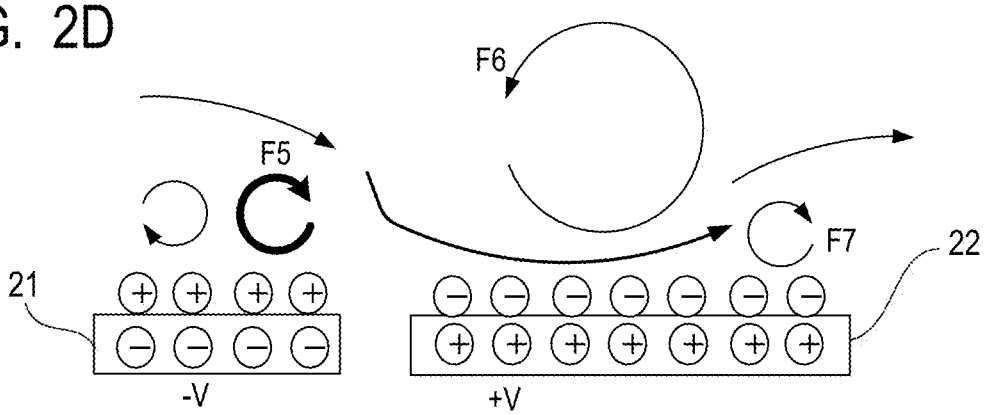
FIG. 2D is a schematic view for describing a mechanism of the generation of driving force by an electroosmotic flow.

On the other hand, in FIGS. 2C and 2D, the size in a direction of the flow path of the second electrode 22 is larger than the size in a direction of the flow path of the first electrode 21. For this reason, the first electrode 21 and the second electrode 22 are different from each other in the electric field distribution. In the vicinity of the first electrode 21, a small rotating vortex F5 having a high flow velocity is formed. In the vicinity of the second electrode 22, a small rotating vortex F7 having a low flow velocity is formed in a part where the potential is low, and a large rotating vortex F6 having a high flow velocity is formed in a part where the potential is high. As a result, the ink is drawn into the gap between the electrodes from the first electrode 21, and an ink flow in which the ink flows from the first electrode 21 to the second electrode 22 is generated.

The above description is also applied even if a positive voltage (+V) is applied to a first electrode 21 and a negative voltage (−V) is applied to a second electrode. That is, even if the polarity of the applied voltage is reversed, both of the sign of the electric charge and the direction of the electric field are reversed, and therefore, the direction of the flow to be generated is not changed. Accordingly, a steady flow from the first electrode 21 with a small size in a direction of the flow path toward the second electrode 22 with a large size in a direction of the flow path is generated.

Due to such an electroosmotic flow, driving force for flowing the ink from the first liquid flow path 13 toward the pressure chamber 20 is generated. That is, due to the electroosmotic flow generated by the first electrode 21 and the second electrode 22, which are arranged in the first liquid flow path 13, the ink flows from the first through port 16 through the first liquid flow path 13 into the pressure chamber 20. When the energy-generating element 11 is operated, a part of the ink flowing into the pressure chamber 20 is ejected from an ejection orifice 12.

Since the electroosmotic flow is generated by an alternating current power supply AC connected to the first electrode 21 and the second electrode 22 even when the energy-generating element 11 is not operated, the ink is stirred in the first liquid flow path 13 and in the pressure chamber 20. For this reason, even if the ink is concentrated inside the pressure chamber 20, the accumulation of the concentrated ink in the pressure chamber 20 can be suppressed. Therefore, a relatively fresh ink that is not thickened or has a small degree of thickening can be ejected from the ejection orifice 12, and the color unevenness of the image can be reduced.

In addition, since a first wiring 24 connected to the first electrode 21 can be arranged between the first through ports 16, the first electrode 21 can be arranged in the first liquid flow path 13 between the first through port and the ejection orifice 12. Therefore, the first and second electrodes 21 and 22 and the ejection orifices 12 can be arranged in a high dense state, and the size of the recording element substrate is easily reduced.

As described above, in the present embodiment, a configuration in which multiple through holes 16 for supplying the ink to the substrate 10 are arranged, and first and second electrodes are arranged in a liquid flow path (first liquid flow path 13) for communicating the through hole 16 and the pressure chamber 20 is adopted. With such a configuration, a liquid ejection head in which the degree of freedom of a layout of the liquid flow path and the like in the substrate is improved, the ejection orifices are arranged in a high dense state, and an electroosmotic flow can be generated can be provided.

Second Embodiment

By using FIGS. 3A to 3C, the configuration of a recording element substrate of the liquid ejection head according to a second embodiment of the present invention will be described. In this regard, in the following description, the difference from the first embodiment will be mainly described, and therefore, for the part where the specific description is omitted, please refer to the description of the first embodiment.

Figure 3A:
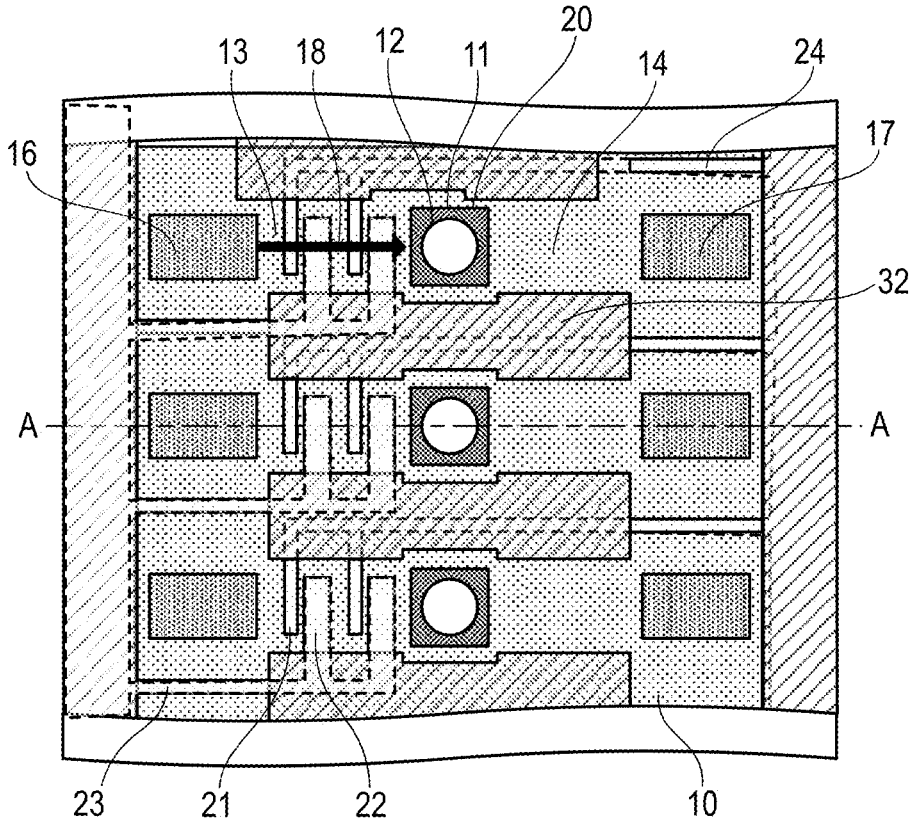
FIG. 3A is a schematic view of the liquid ejection head according to a second embodiment of the present invention.
Figure 3B:
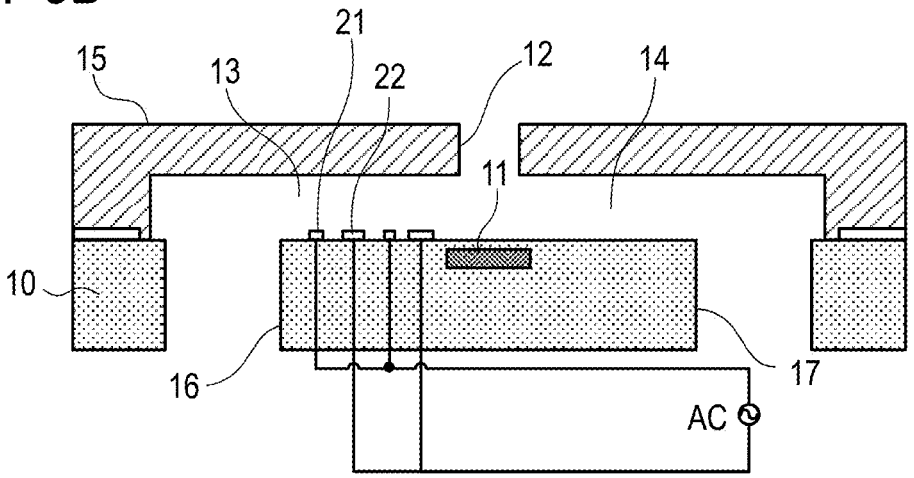
FIG. 3B is a schematic view of the liquid ejection head according to the second embodiment of the present invention.
Figure 3C:
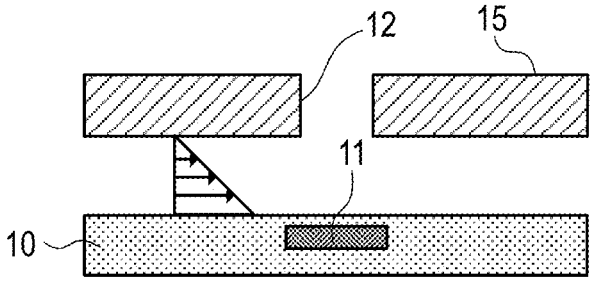
FIG. 3C is a schematic view showing a flow velocity distribution in the liquid ejection head according to the second embodiment of the present invention.

FIG. 3A is a sectional view of a recording element substrate of the liquid ejection head according to the second embodiment of the present invention, FIG. 3B is a sectional view taken along the line A-A in FIG. 3A, and FIG. 3C is a schematic view showing a flow velocity distribution in the same cross section as that in FIG. 3B.

In the present embodiment, a second liquid flow path 14 is arranged downstream of a pressure chamber 20 with respect to the direction of an ink flow. No first electrode 21 and no second electrode 22 are arranged in a second liquid flow path 14. In a substrate 10, multiple second through ports 17 penetrating the substrate 10 from the front surface to the back surface are formed. As a result, the pressure chamber 20 provided with an ejection orifice 12 is arranged between a first liquid flow path 13 and the second liquid flow path 14. In addition, a first through port 16, the first liquid flow path 13, the pressure chamber 20, the second liquid flow path 14, and the second through port 17 form an independent flow path for each ejection orifice 12. The ink that has not been ejected at the ejection orifice 12 flows through the second liquid flow path 14 to the second through port 17. The ink flowing out of the liquid ejection head flows into the liquid ejection head again after passing through an ink tank or the like of a recording apparatus. As described above, the ink in the pressure chamber 20 is circulated between the pressure chamber 20 and the outside according to the embodiment of the present invention. In addition, the present invention can be applied not only to a configuration in which the ink is circulated between the liquid ejection head and the outside, but also to a configuration in which the ink circulates inside the liquid ejection head (ink flows between the inside and the outside of the pressure chamber 20).

With such a configuration, an ink flow passing through the pressure chamber 20 occurs even when the ink is not ejected, and the accumulation of thickened ink can be suppressed at the ejection orifice 12. Therefore, the thickening of the ink is reduced and the color unevenness can be reduced.

Third Embodiment

By using FIGS. 4A to 4C, the configuration of a recording element substrate of the liquid ejection head according to a third embodiment of the present invention will be described. In this regard, in the following description, the difference from the second embodiment will be mainly described, and therefore, for the part where the specific description is omitted, please refer to the description of the second embodiment.

Figure 4A:
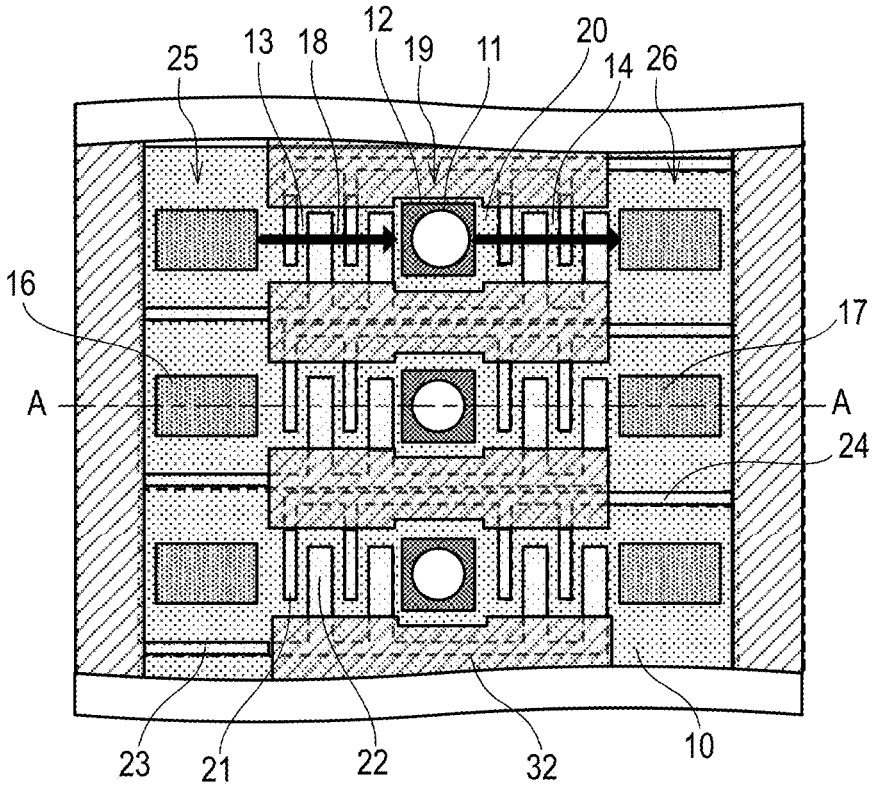
FIG. 4A is a schematic view of the liquid ejection head according to a third embodiment of the present invention.
Figure 4B:
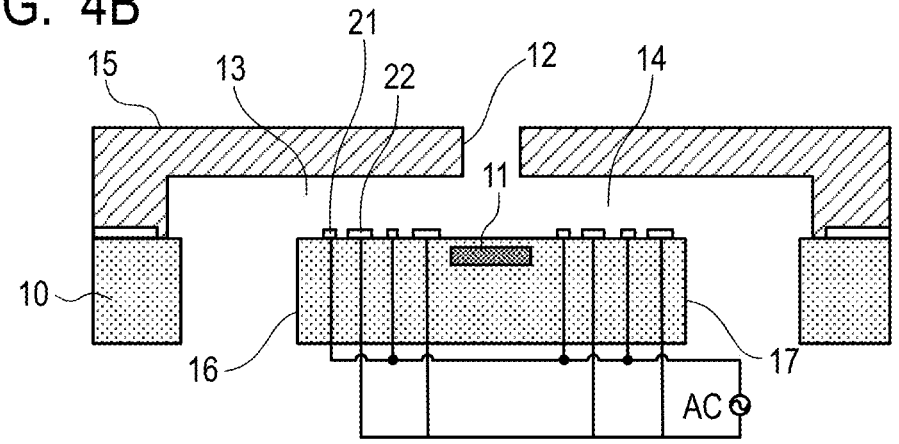
FIG. 4B is a schematic view of the liquid ejection head according to the third embodiment of the present invention.
Figure 4C:
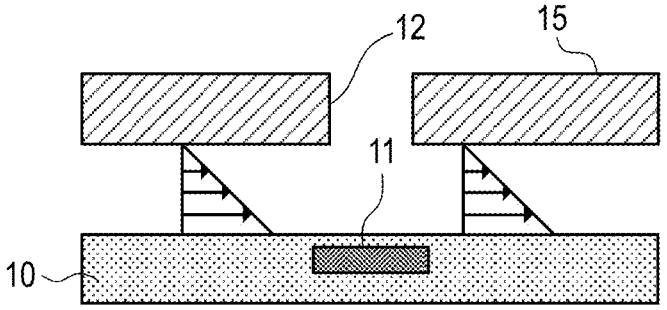
FIG. 4C is a schematic view showing a flow velocity distribution in the liquid ejection head according to the third embodiment of the present invention.

FIG. 4A is a sectional view of a recording element substrate of the liquid ejection head according to the third embodiment of the present invention, FIG. 4B is a sectional view taken along the line A-A in FIG. 4A, and FIG. 4C is a schematic view showing a flow velocity distribution in the same cross section as that in FIG. 4B.

In the present embodiment, a first electrode 21 and a second electrode 22 are arranged in a second liquid flow path 14. The other configuration is the same as that in the second embodiment. Since the first electrode 21 and the second electrode 22 are arranged in each of a first liquid flow path 13 and the second liquid flow path 14, the effect of discharging a concentrated ink inside an ejection orifice 12 is large. As a result, the concentrated ink hardly stays inside a pressure chamber 20. Therefore, the thickening of the ink is further reduced and the color unevenness can be reduced.

Fourth Embodiment

By using FIGS. 5A to 7C, the configuration of a recording element substrate of the liquid ejection head according to a fourth embodiment of the present invention will be described. In this regard, in the following description, the difference from the first to third embodiments will be mainly described, and therefore, for the part where the specific description is omitted, please refer to the description of the first to third embodiments.

Figure 5A:
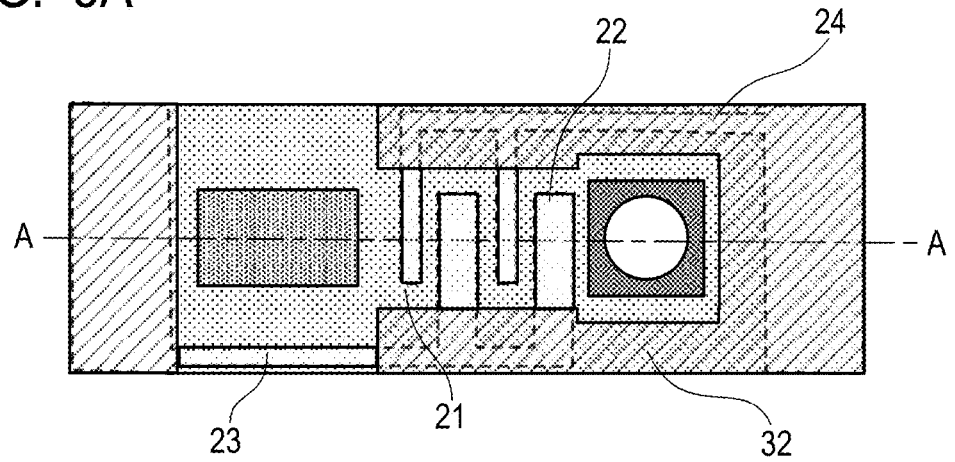
FIG. 5A is a schematic view of the liquid ejection head according to a fourth embodiment of the present invention.
Figure 5B:
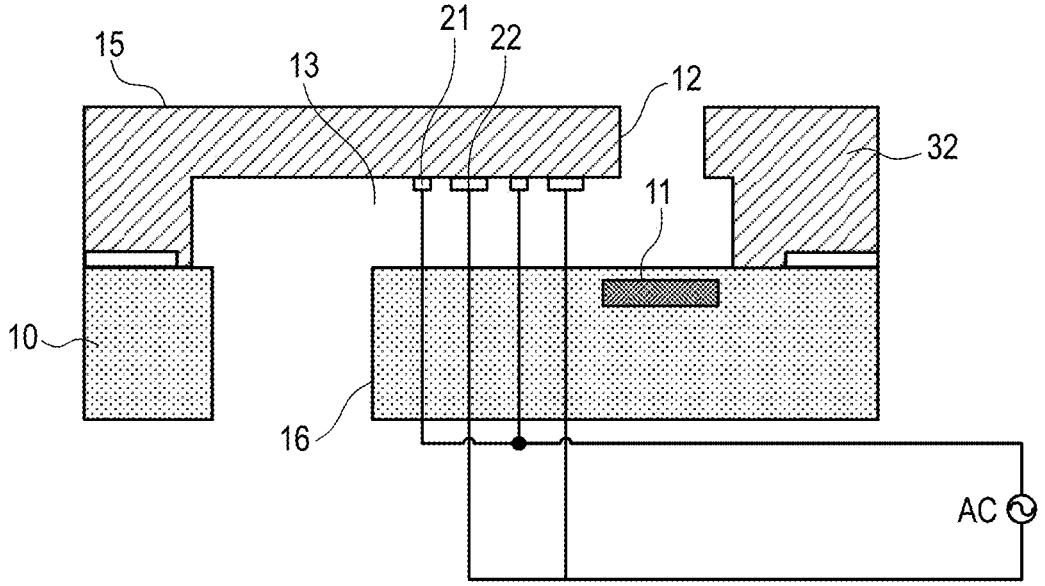
FIG. 5B is a schematic view of the liquid ejection head according to the fourth embodiment of the present invention.
Figure 5C:
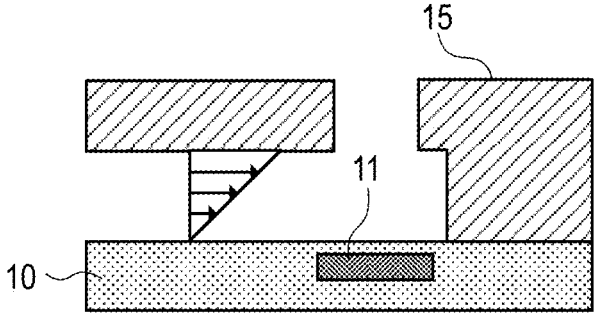
FIG. 5C is a schematic view showing a flow velocity distribution in the liquid ejection head according to the fourth embodiment of the present invention.

FIG. 5A is a sectional view of a recording element substrate of the liquid ejection head according to the fourth embodiment of the present invention, FIG. 5B is a sectional view taken along the line A-A in FIG. 5A, and FIG. 5C is a schematic view showing a flow velocity distribution in the same cross section as that in FIG. 5B.

In the present embodiment, a first electrode 21 and a second electrode 22 are arranged on a back surface of an ejection orifice forming member 15. The back surface means a surface facing a pressure chamber 20 of the ejection orifice forming member 15. Accordingly, filling of the electric double layers is generated on electrodes on the back surface of the ejection orifice forming member 15. As a result, as shown in FIG. 5C, in a liquid flow path, a flow velocity distribution in which the flow velocity is high on the back surface of the ejection orifice forming member 15 and asymptotically approaches zero toward a front surface of a substrate 10, is generated. In a case where the first electrode 21 and the second electrode 22 are driven at the same frequency as that of the alternating current power supply AC that is the same as that in the first embodiment, the flow velocity on the back side of the ejection orifice forming member 15 is high, and therefore, the concentration of an ink in the ejection orifice 12 is easily eliminated. Accordingly, the thickening of the ink can be more efficiently reduced.

Figure 6A:
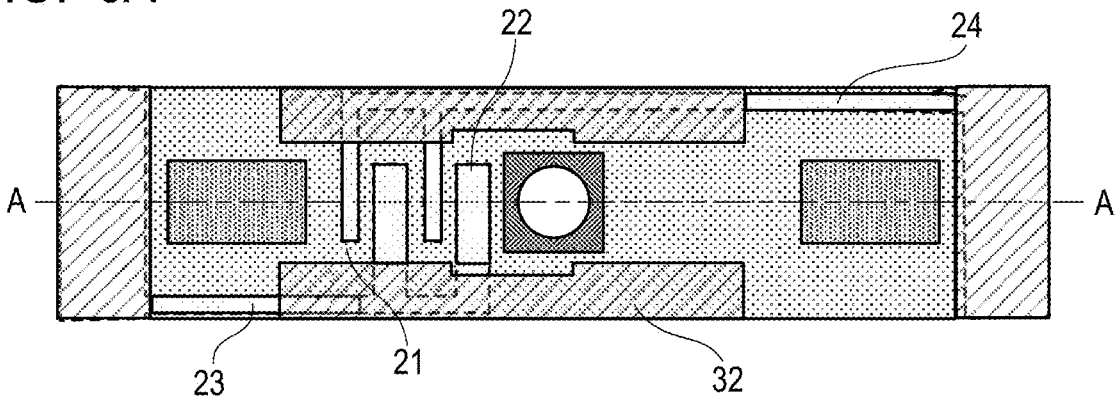
FIG. 6A is a schematic view of the liquid ejection head according to a fourth embodiment (modified example) of the present invention.
Figure 6B:
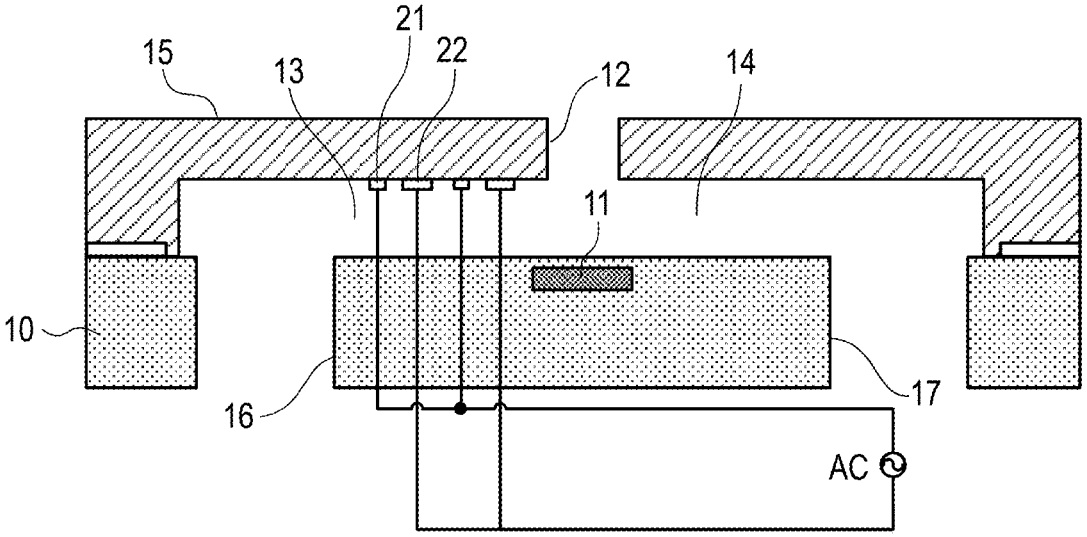
FIG. 6B is a schematic view of the liquid ejection head according to the fourth embodiment (modified example) of the present invention.
Figure 6C:
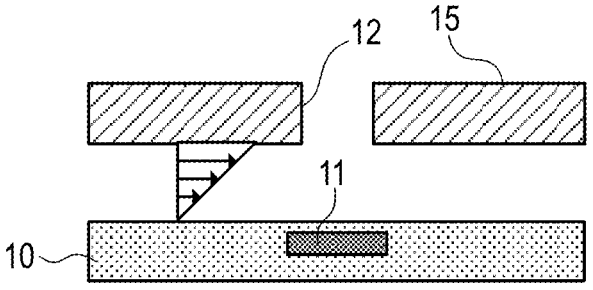
FIG. 6C is a schematic view showing a flow velocity distribution in the liquid ejection head according to the fourth embodiment (modified example) of the present invention.

The present embodiment can also be applied to the second and third embodiments. FIG. 6A is a sectional view of a recording element substrate of the liquid ejection head according to a modified example of the fourth embodiment of the present invention, FIG. 6B is a sectional view taken along the line A-A in FIG. 6A, and FIG. 6C is a schematic view showing a flow velocity distribution in the same cross section as that in FIG. 6B. In the present embodiment, in a similar manner as in the second embodiment, a second liquid flow path 14 and a second through port 17 penetrating a substrate 10 are arranged downstream of a pressure chamber 20 with respect to the direction of an ink flow. No first electrode 21 and no second electrode 22 are arranged in the second liquid flow path 14. According to the present embodiment, in a similar manner as in the second embodiment, an ink flow passing through the pressure chamber 20 is formed even when the ink is not ejected, and the color unevenness of the image can be reduced.

Figure 7A:
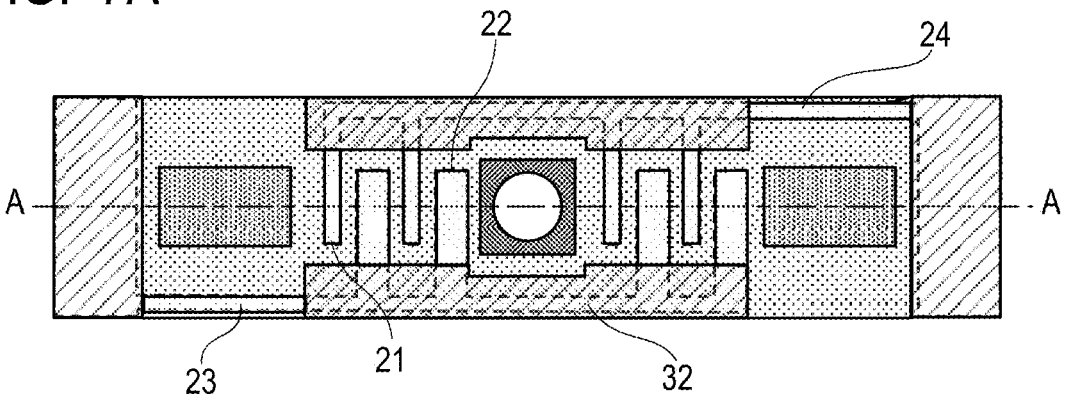
FIG. 7A is a schematic view of the liquid ejection head according to a fourth embodiment (modified example) of the present invention.
Figure 7B:
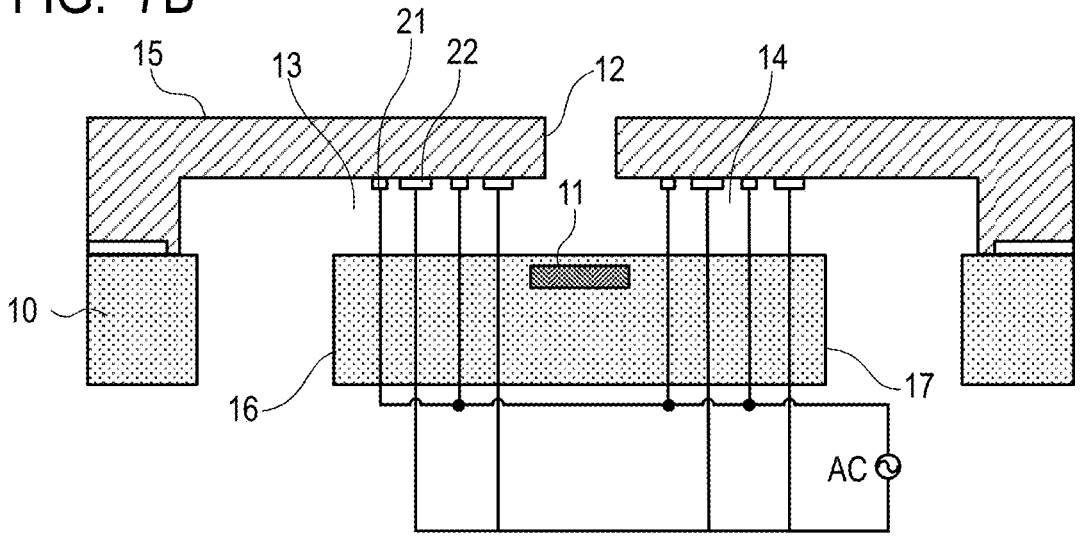
FIG. 7B is a schematic view of the liquid ejection head according to the fourth embodiment (modified example) of the present invention.
Figure 7C:
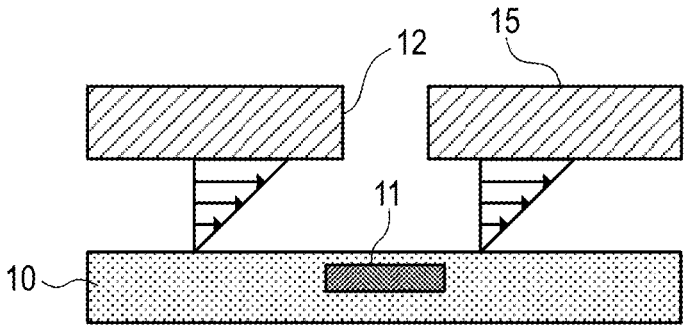
FIG. 7C is a schematic view showing a flow velocity distribution in the liquid ejection head according to the fourth embodiment (modified example) of the present invention.

FIG. 7A is a sectional view of a recording element substrate of the liquid ejection head according to another modified example of the fourth embodiment of the present invention, FIG. 7B is a sectional view taken along the line A-A in FIG. 7A, and FIG. 7C is a schematic view showing a flow velocity distribution in the same cross section as that in FIG. 7B. In the present embodiment, in a similar manner as in the third embodiment, a second liquid flow path 14 and a second through port 17 penetrating a substrate 10 are arranged in the downstream of a pressure chamber 20 with respect to the direction of an ink flow. In addition, a first electrode 21 and a second electrode 22 are arranged in the second liquid flow path 14. Therefore, in a similar manner as in the third embodiment, the effect of discharging a concentrated ink inside an ejection orifice 12 is large, and the color unevenness of the image can be further reduced. The above-described first to fourth embodiments can also be further modified. Although a drawing is omitted, for example, first and second electrodes 21 and 22 of a first liquid flow path 13 can be arranged on a back surface of an ejection orifice forming member 15, and first and second electrodes 21 and 22 of a second liquid flow path 14 can be arranged on a front surface of a substrate 10. As a result, the flow velocity on the back surface of the ejection orifice forming member 15 is increased, and the concentration inside an ejection orifice 12 is easily suppressed. Further, by arranging the electrodes of the second liquid flow path 14 on the substrate 10, the concentrated ink easily flows out.

Fifth Embodiment

Using FIGS. 8A to 10C, the configuration of a recording element substrate of the liquid ejection head according to a fifth embodiment of the present invention will be described. In this regard, in the following description, the difference from the first to third embodiments will be mainly described, and therefore, for the part where the specific description is omitted, please refer to the description of the first to third embodiments.

Figure 8A:
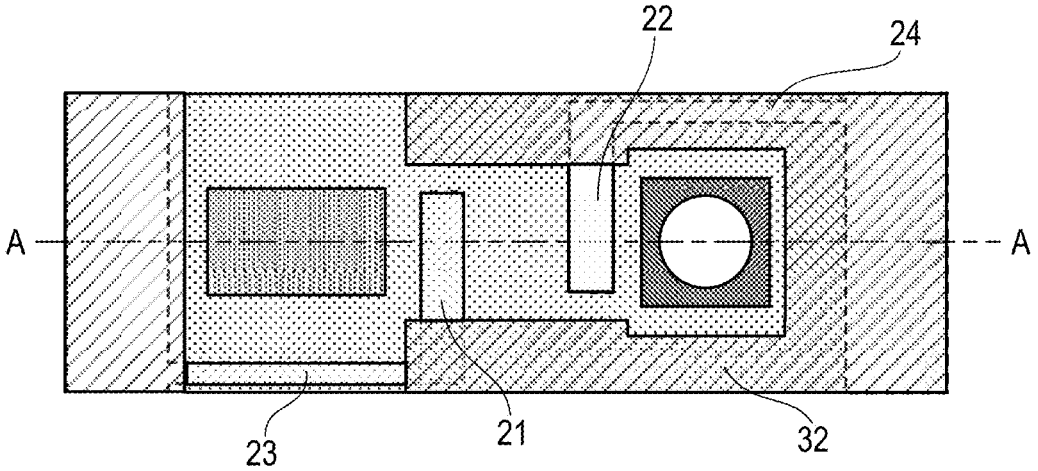
FIG. 8A is a schematic view of the liquid ejection head according to a fifth embodiment of the present invention.
Figure 8B:
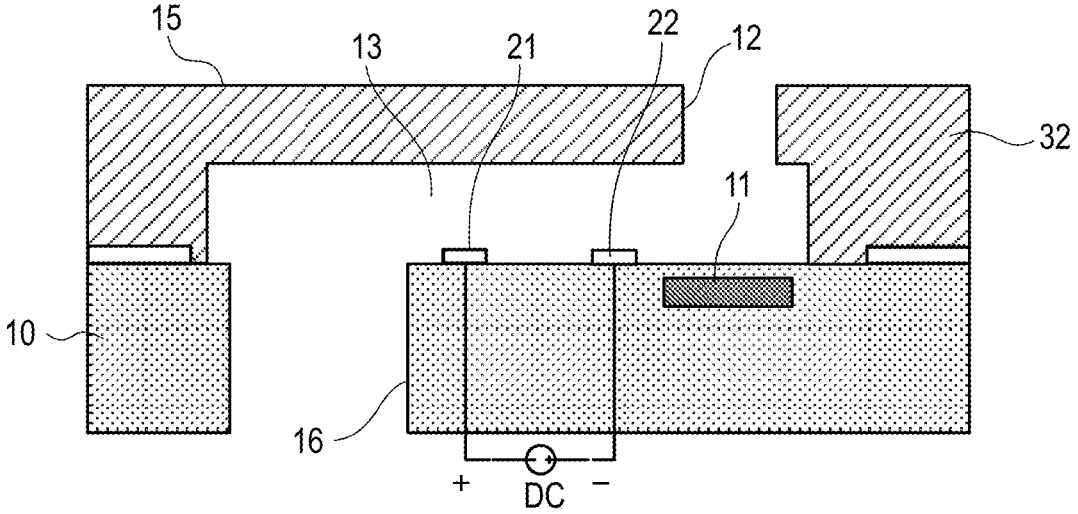
FIG. 8B is a schematic view of the liquid ejection head according to the fifth embodiment of the present invention.
Figure 8C:
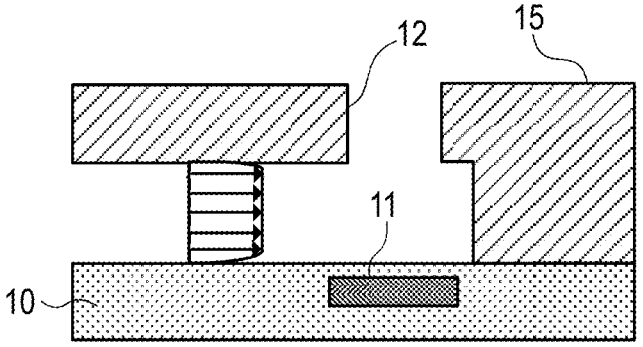
FIG. 8C is a schematic view showing a flow velocity distribution in the liquid ejection head according to the fifth embodiment of the present invention.

FIG. 8A is a sectional view of a recording element substrate of the liquid ejection head according to the fifth embodiment of the present invention, FIG. 8B is a sectional view taken along the line A-A in FIG. 8A, and FIG. 8C is a schematic view showing a flow velocity distribution in the same cross section as that in FIG. 8B.

In the present embodiment, a first electrode 21 and a second electrode 22 are connected to a direct current power supply DC. More specifically, a first electrode 21 is connected to a positive electrode of a direct current power supply DC, and a second electrode 22 is connected to a negative electrode of the direct current power supply DC. The sizes of the first electrode 21 and the second electrode 22 are the same, but may be different from each other as in the first embodiment. The electrodes are arranged on a substrate 10, but may be arranged on a back surface of an ejection orifice forming member 15.

As shown in FIG. 8C, the flow velocity distribution generally shows a flow velocity distribution close to a plug flow. The reason why such a flow velocity distribution is generated is as follows. When an electric field parallel to a wall surface is applied from the outside, the solid surface is negatively charged, and positive ions become excessive in a liquid in the vicinity of the interface. As a result, the liquid is positively charged locally, ions of the electric double layer receive the force in a direction of the electric field, and the ink moves in the vicinity of the wall. Because of the direct current power supply DC, it is required to drive the electrodes at a voltage at which electrolysis of the liquid is not generated (the voltage is preferably around 1 V or less in a case of water), and the flow velocity to be obtained is lower than that in a case where an alternating current power supply AC is used. However, the ink flow can be generated only by connecting the first electrode 21 and the second electrode 22 to a direct current power supply DC, and therefore, a configuration simpler than that in the first embodiment can be obtained.

Figure 9A:
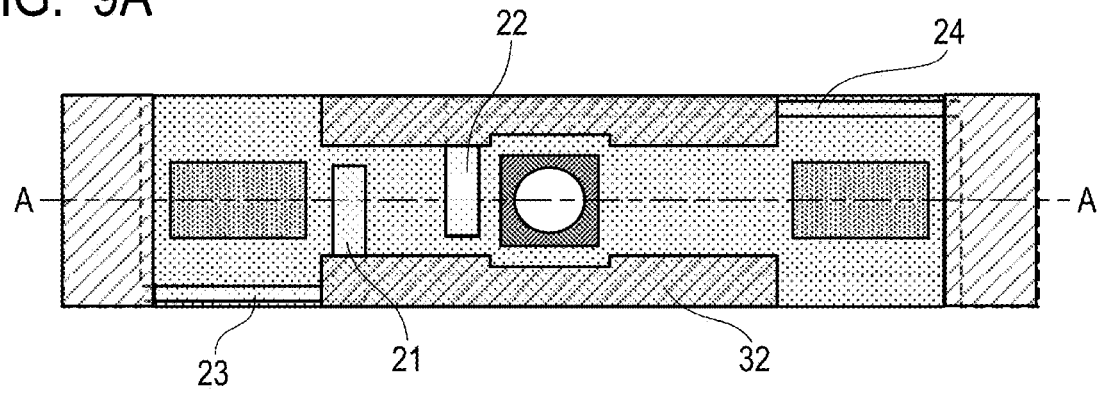
FIG. 9A is a schematic view of the liquid ejection head according to a fifth embodiment (modified example) of the present invention.
Figure 9B:
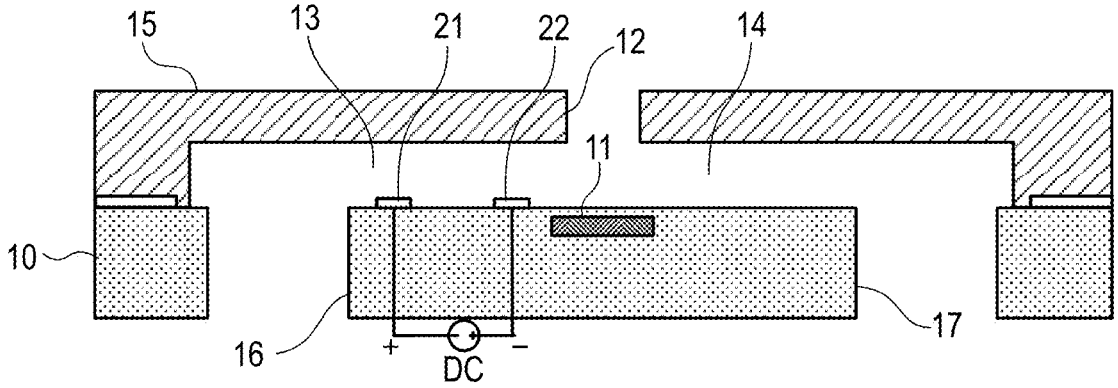
FIG. 9B is a schematic view of the liquid ejection head according to the fifth embodiment (modified example) of the present invention.
Figure 9C:
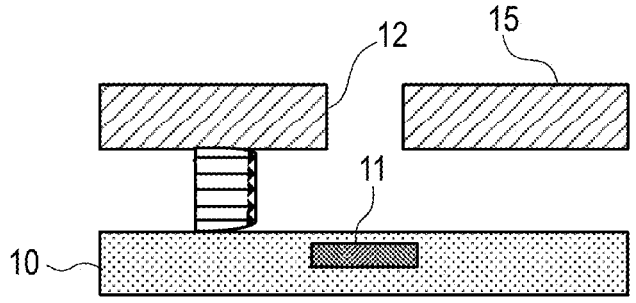
FIG. 9C is a schematic view showing a flow velocity distribution in the liquid ejection head according to the fifth embodiment (modified example) of the present invention.
Figure 10A:
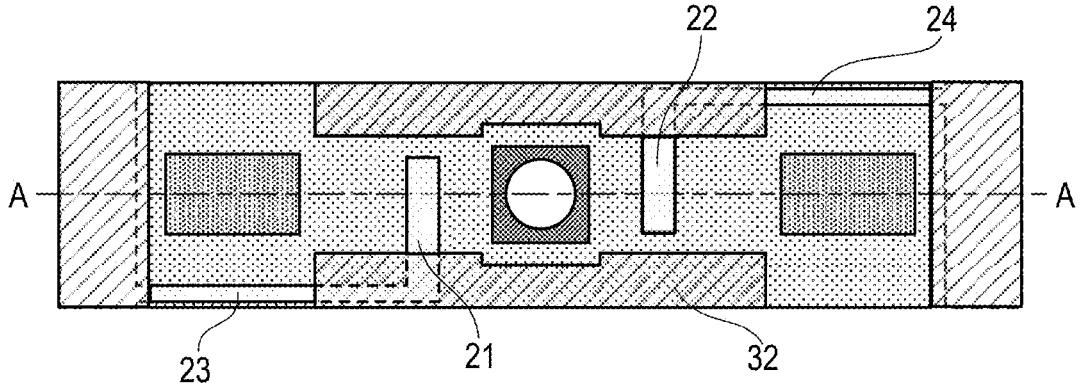
FIG. 10A is a schematic view of the liquid ejection head according to a fifth embodiment (modified example) of the present invention.
Figure 10B:
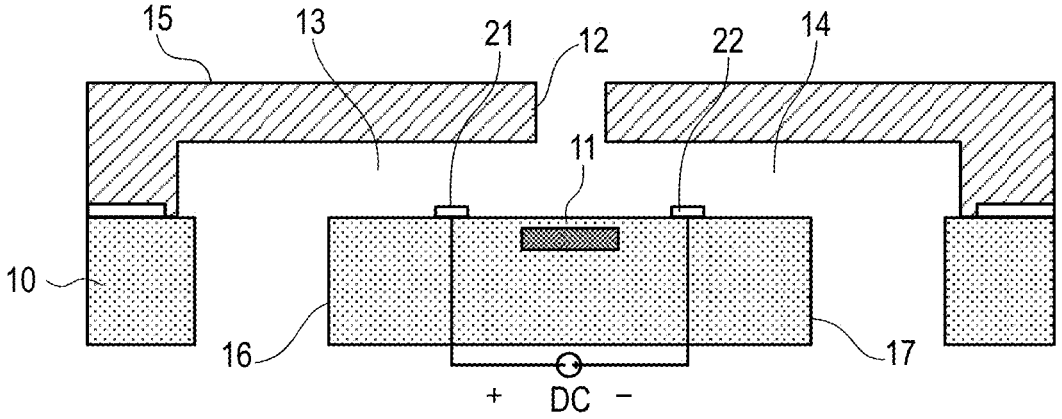
FIG. 10B is a schematic view of the liquid ejection head according to the fifth embodiment (modified example) of the present invention.
Figure 10C:
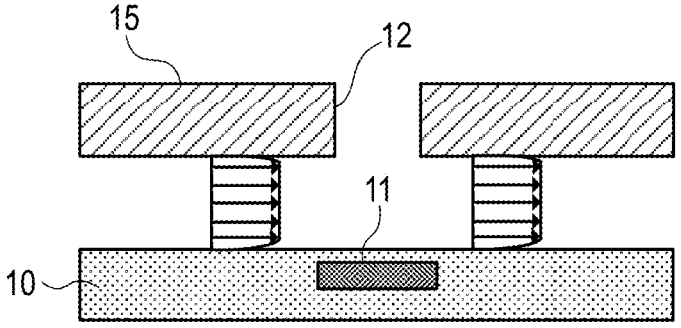
FIG. 10C is a schematic view showing a flow velocity distribution in the liquid ejection head according to the fifth embodiment (modified example) of the present invention.

The present embodiment can also be applied to the second and third embodiments. FIG. 9A is a sectional view of a recording element substrate of the liquid ejection head according to a modified example of the fifth embodiment of the present invention, FIG. 9B is a sectional view taken along the line A-A in FIG. 9A, and FIG. 9C is a schematic view showing a flow velocity distribution in the same cross section as that in FIG. 9B. A first electrode 21 and a second electrode 22 are arranged in a first liquid flow path 13. In the present embodiment, in a similar manner as in the second embodiment, a second liquid flow path 14 and a second through port 17 penetrating a substrate 10 are arranged downstream of a pressure chamber 20 with respect to the direction of an ink flow. No first electrode 21 and no second electrode 22 are arranged in the second liquid flow path 14. According to the present embodiment, in a similar manner as in the second embodiment, an ink flow passing through the pressure chamber 20 is formed even when the ink is not ejected, and the color unevenness of the image can be reduced. FIG. 10A is a sectional view of a recording element substrate of the liquid ejection head according to another modified example of the fifth embodiment of the present invention, FIG. 10B is a sectional view taken along the line A-A in FIG. 10A, and FIG. 10C is a schematic view showing a flow velocity distribution in the same cross section as that in FIG. 10B. In the present embodiment, in a similar manner as in the third embodiment, a second liquid flow path 14 and a second through port 17 penetrating a substrate 10 are arranged downstream of a pressure chamber 20 with respect to the direction of an ink flow. In addition, a first electrode 21 and a second electrode 22 are arranged in the second liquid flow path 14. Therefore, the effect of discharging a concentrated ink inside an ejection orifice 12 is large, and the color unevenness of the image can be further reduced.

According to the present invention, a liquid ejection head with which the thickening of a liquid due to the evaporation of the liquid from an ejection orifice can be reduced and in which ejection orifices can be arranged in a high dense state can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A liquid ejection head, comprising:

an ejection orifice forming member provided with an ejection orifice array arraying a plurality of ejection orifices for ejecting a liquid;

a plurality of energy-generating elements for generating energy in order to eject the liquid;

a substrate provided with the plurality of energy-generating elements;

a through-port array arraying a plurality of through-ports penetrating the substrate;

a plurality of linear liquid flow paths positioned between the through-port array and the ejection orifice array, and connected to respective ejection orifices of the ejection orifice array and respective through-ports of the through-port array; and electrodes arranged in each of the plurality of liquid flow paths for generating an electroosmotic flow in the liquid, wherein the electrodes in each of the liquid flow paths include a first electrode and a second electrode, the first electrode and the second electrode extending in directions opposite each other from one end side and another end side, respectively, in a direction orthogonal to an extending direction of the liquid flow paths, and wherein the electrodes are arranged on the ejection orifice forming member.

2. The liquid ejection head according to claim 1, wherein the first electrode is connected to one end of an alternating current power supply, and the second electrode is connected to the other end of the alternating current power supply.

3. The liquid ejection head according to claim 1, wherein the first electrode and the second electrode are arranged alternately, and are different from each other in size in the extending direction of the liquid flow path.

4. The liquid ejection head according to claim 1, wherein the first electrode is connected to one end of a direct current power supply, and the second electrode is connected to the other end of the direct current power supply.

5. The liquid ejection head according to claim 1, further comprising second liquid flow paths communicating with the ejection orifices on an opposite side of the liquid flow paths with respect to the ejection orifices.

6. The liquid ejection head according to claim 5, wherein an additional electrode for generating an electroosmotic flow in the liquid is arranged in the second liquid flow path.

7. The liquid ejection head according to claim 5, wherein the liquid ejection head has additional through-ports penetrating the substrate on the opposite side of the liquid flow paths with respect to the ejection orifices, and the second liquid flow paths are arranged between the ejection orifices and the additional through-ports.

8. The liquid ejection head according to claim 1, further comprising pressure chambers each having one of the energy-generating elements therein, and the liquid in the pressure chambers circulates between the pressure chambers and outside of the pressure chambers.

9. A liquid ejection head, comprising:

an ejection orifice forming member provided with an ejection orifice for ejecting a liquid;

an energy-generating element for generating energy in order to eject the liquid;

a substrate provided with the energy-generating element;

a through-port penetrating the substrate;

a linear liquid flow path connected to the ejection orifice and the through-port; and electrodes arranged in the liquid flow path, and for generating an electroosmotic flow in the liquid, wherein the electrodes include a first electrode and a second electrode, the first electrode and the second electrode extending in directions opposite each other from one end side and another end side, respectively, in a direction orthogonal to an extending direction of the liquid flow path, and wherein the electrodes are arranged on the ejection orifice forming member.

10. The liquid ejection head according to claim 9, further comprising a pressure chamber having the energy-generating element therein, and the liquid in the pressure chamber circulates between the pressure chamber and outside of the pressure chamber.

11. A liquid ejection head, comprising:

an ejection orifice forming member provided with an ejection orifice array arraying a plurality of ejection orifices in order to eject a liquid;

a plurality of energy-generating elements for generating energy in order to eject the liquid;

a substrate provided with the plurality of energy-generating elements;

a through-port array arraying a plurality of through-ports penetrating the substrate;

a plurality of liquid flow paths positioned between the ejection orifice array and the through-port array, and connected to respective ejection orifices of the ejection orifice array and respective through-ports of the through-port array;

electrodes arranged in each of the plurality of liquid flow paths for generating an electroosmotic flow in the liquid; and wirings connected to the electrodes, respectively, and passing through between adjacent through-ports in the through-port array, wherein the electrodes in each of the liquid flow paths include a first electrode and a second electrode, the first electrode and the second electrode extending in directions opposite each other from one end side and another end side, respectively, in a direction orthogonal to an extending direction of the liquid flow paths, and wherein the electrodes are arranged on the ejection orifice forming member.

12. The liquid ejection head according to claim 11, further comprising pressure chambers each having one of the energy-generating elements therein, and the liquid in the pressure chambers circulates between the pressure chambers and outside of the pressure chambers.

* * * * *